US006439315B2

(12) United States Patent
Onuki

(10) Patent No.: US 6,439,315 B2
(45) Date of Patent: Aug. 27, 2002

(54) AUTOMATIC SPRINKLER HEAD

(75) Inventor: Hiroshi Onuki, Tokyo (JP)

(73) Assignee: Senju Sprinkler Company Limited, Tokyo (JP)

( * ) Notice: Subject to any disclaimer, the term of this patent is extended or adjusted under 35 U.S.C. 154(b) by 0 days.

(21) Appl. No.: 09/847,343

(22) Filed: May 3, 2001

(30) Foreign Application Priority Data

Jun. 20, 2000 (JP) ..... 2000-223083
Jan. 19, 2001 (JP) ..... 2001-47385

(51) Int. Cl.[7] ..... A62C 37/08

(52) U.S. Cl. ..... 169/37; 169/38; 169/42; 169/56; 169/57; 169/59; 169/60

(58) Field of Search ..... 169/37, 38, 42, 169/56, 57, 59, 60

(56) References Cited

U.S. PATENT DOCUMENTS 4,651,832 A * 3/1987 Kubo
4,660,648 A * 4/1987 Zen ..... 169/38
4,805,701 A * 2/1989 Mountford ..... 169/57
5,368,265 A * 11/1994 Gueli ..... 169/42 X
5,431,303 A * 7/1995 Miskell ..... 222/54
6,044,912 A * 4/2000 Tsuji et al. ..... 169/37

* cited by examiner

*Primary Examiner*—Robin O. Evans
(74) *Attorney, Agent, or Firm*—Wenderoth, Lind & Ponack, L.L.P.

(57) ABSTRACT

A sprinkler head includes a body having one end adapted for connection to a supply of pressurized fluid and the other end closed by a valve element, and a thermally responsive assembly for normally holding the valve element in a closed position and opening the valve element at a preset temperature to cause the pressurized fluid to flow out of the other end of the body. The thermally responsive assembly includes a holder and a fusible alloy contained within the holder and held in place by a plunger. The fusible alloy is free of lead and/or cadmium and includes at least two materials selected from the group consisting of tin, bismuth, indium, zinc, gallium and silver.

7 Claims, 1 Drawing Sheet

AUTOMATIC SPRINKLER HEAD

BACKGROUND OF THE INVENTION

The present invention generally relates to automatic sprinkler heads and in particular, to thermally responsive assemblies of the type in which a valve is opened at a preset temperature so as to disburse a fire retardant fluid to suppress or extinguish a fire in a designated area.

Automatic sprinkler heads include a valve element which is normally maintained in a closed position by thermally responsive means. Such means include a heat sensitive material such as alcohol or a low melting alloy. One type of such sprinkler heads utilizes a frangible glass bulb filled with alcohol and air. The frangible bulb is disposed between the body of the sprinkler head and a valve so as to maintain the valve in a closed state under normal conditions. When the sprinkler head is exposed to a predetermined elevated temperature, the frangible bulb expands to burst the bulb. This causes the valve to be opened so that a stream of a fire retardant fluid rushes from the outlet of the body. The frangible glass bulb is simple in structure and inexpensive and easy to manufacture. However, the frangible glass bulb may not always be actuated as required at a preset temperature since the responsiveness of the bulb depends on a variety of factors such as the thickness and strength of the bulb and the amount of alcohol and air contained within the bulb.

Another known sprinkler head utilizes a fusible link composed of two metal sheets laminated with solder in a lap joint to form a fusible region. The fusible link extends between two levers. The fusible link provides a retaining force on one of the levers which in turn, provides an upward force on the other lever to hold a valve element in its closed position. In response to elevated temperature, the solder melts to release the levers and thus, the valve element. This allows fluid flow from the sprinkler head. Unlike the frangible glass bulb, the fusible link provides for reliable activation of the sprinkler head as the solder used has a low melting point. However, a disadvantage of such a lap joint type sprinkler head is that the two metal sheets tend to creep away over time. This is due to the fact that the fusible region is subjected to a force by which the valve element is held in its closed position, and another force by which the links and the valve element are brown away when the solder melts.

There has also been proposed a compression type sprinkler head wherein a fusible alloy is normally contained within a fuse holder and held in place by a plunger. When a fire occurs, the fusible alloy melts. This melting causes the plunger to drop. Various components of the thermally responsive assembly are then dislodged from the body of the sprinkler head to allow opening of a valve. This compression type sprinkler head responds reliably in the event of a raise in ambient temperature since it utilizes a low melting alloy as a heat sensitive agent. As a further advantage, the thermally responsive assembly is free from creep since the low melting alloy is constantly pressed within the fuse holder by the plunger.

The melting point of a suitable fusible alloy for most residential and commercial buildings is typically 72° C. A fusible alloy having a higher melting point, for example, in the range from 90° C. to 190° C., will be used in installations where elevated temperatures may be encountered under normal circumstances. Fusible alloys used in the prior art sprinkler heads include lead and/or cadmium. Typically, a fusible alloy having a melting point of 72° C. consists of 50 percent by weight of bismuth, 12.5 percent by weight of cadmium, 25 percent by weight of lead, and 12.5 percent by weight of tin. A fusible alloy having a melting point of 96° C. consists of 52 percent by weight of bismuth, 32 percent by weight of lead, and 16 percent by weight of tin. Also, a fusible alloy having a melting point of 183° C. consists of 37 percent by weight of lead and 63 percent by weight of tin. However, as both lead and cadmium are toxic to the environment, such fusible alloys are banned from land disposal, there is a need for a thermally responsive assembly which is free of lead and cadmium and which can be disposed safely.

Accordingly, it is an object of the present invention to provide a thermally responsive assembly for sprinkler heads which is free of lead and cadmium.

SUMMARY OF THE INVENTION

To achieve the foregoing object, the present invention provides an automatic sprinkler head comprising a body having one end adapted for connection to a supply of pressurized fluid and the other end closed by a valve element, and a thermally responsive assembly for normally holding the valve element in a closed position and opening the valve element at a preset temperature to cause the pressurized fluid to flow out of the other end of the body. The thermally responsive assembly includes a holder and a fusible alloy contained within the holder and held in place by a plunger. As a feature, the fusible alloy includes at least two materials selected from the group consisting of tin, bismuth, indium, zinc, gallium and silver.

In one embodiment, the fusible alloy consists of indium and bismuth. This alloy can have a melting point in the range from 72° C. to 100° C. depending on their content. Alternatively, the fusible alloy may consist of tin, bismuth and indium and can have a melting point in the range from 59° C. to 120° C. Still alternatively, the fusible alloy may consist of tin, zinc and bismuth and can have a melting point in the range from 130° C. to 200° C. Gallium and silver may be added to these composite alloys to increase the operating temperature range of the thermally responsive assembly.

BRIEF DESCRIPTION OF THE DRAWINGS

The above and other objects, features and advantages of the present invention will become apparent from a reading of the following detailed description of the invention, when taken in conjunction with the accompanying figure; in which.

DETAILED DESCRIPTION OF THE INVENTION

Figure 1:
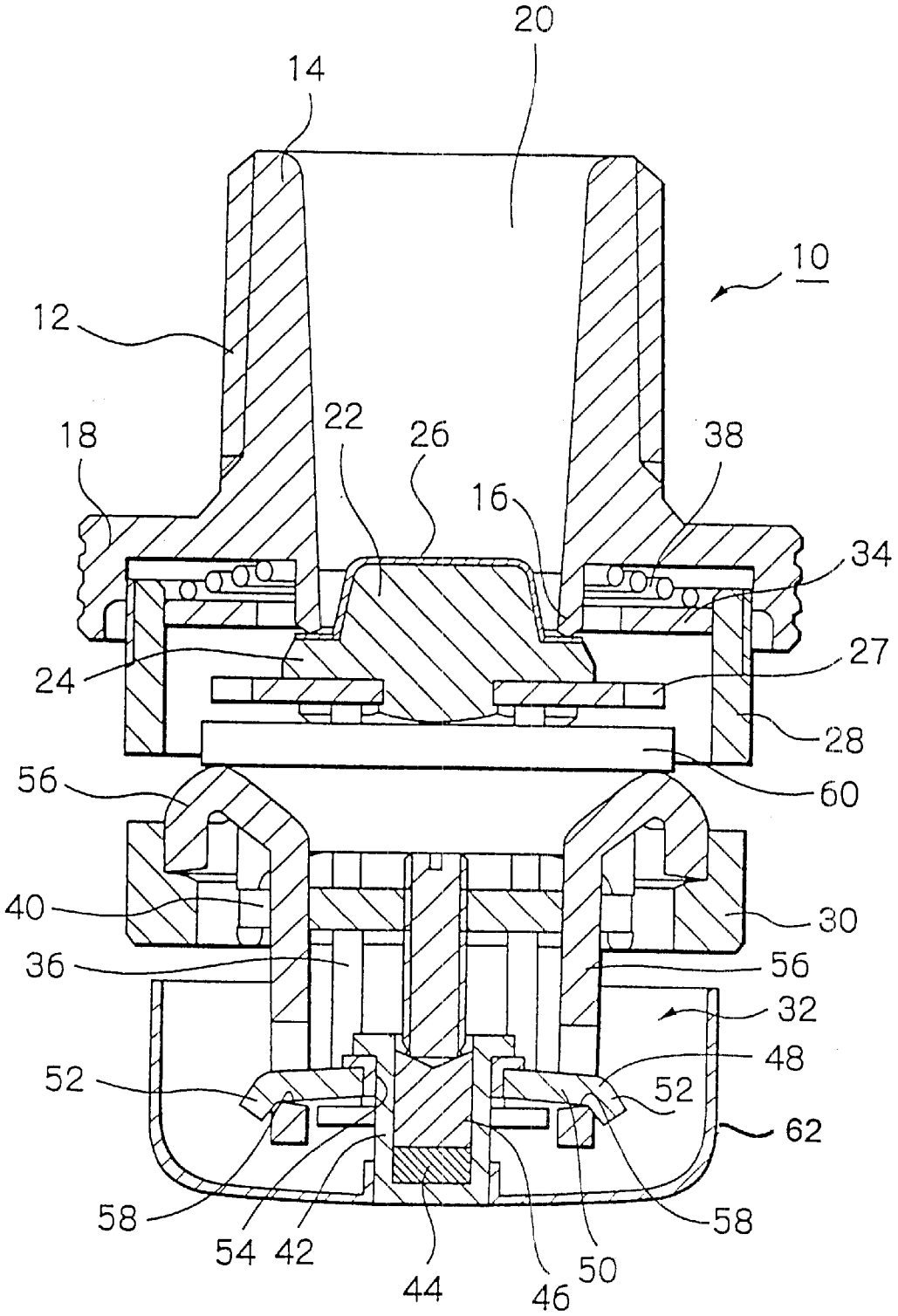
FIG. 1 is a vertical section of a compression type sprinkler head according to one embodiment of the present invention.

Referring now to FIG. 1, there is shown a compression type sprinkler head made according to one embodiment of the present invention and generally designated at 10. The sprinkler head 10 includes a tubular body 12 with an inlet end 14 and an opposite, discharge end 16, and a cylindrical end flange 18 extending outwardly from the discharge end 16 of the tubular body 12. The tubular body 12 includes an internal passage 20 which extends between the inlet end 14 and the discharge end 16 of the tubular body 12 and is communicated with a water supply line (not shown). The discharge end 16 of the tubular body 12 serves as a valve seat for a valve element 22. The valve element 22 includes an outwardly extending annular flange 24 which normally seats against the discharge end 16 of the tubular body 12. A suitable gasket 26 is attached to the rear side of the valve element 22 to seal the discharge end 16 of the tubular body 12. A deflector 27 is secured to the front side of the valve element 22.

A cylindrical frame 28 is secured to the end flange 18. The frame 28 includes an inwardly extending annular flange 30 adapted to normally support a thermally responsive assembly 32. A ring 34 is normally placed around the discharge end 16 of the tubular body 12 within the frame 28. A plurality of guide struts (two are shown) 36 extend perpendicularly from one side of the ring 34. A compression spring 38 is disposed between the other side of the ring 34 and the bottom of the end flange 18.

The thermally responsive assembly 32 is releasably attached to the open end of the frame 28 so as to normally urge the valve element 22 into its closed position. More specifically, the thermally responsive assembly 32 includes a generally H-shaped support plate 40, a cylindrical holder 42 within which a fusible alloy 44 is contained, and a plunger assembly 46 secured to the support plate 40 and adapted to normally press the fusible alloy 44 within the holder 42. A link 48 has a circular portion 50, and a pair of projections 52, 52 extending radially from the circular portion 50 in a diametrically opposed relation. The circular portion 50 has an opening 54 to receive the holder 42. A pair of levers 56, 56 have an inverted J-shape and are formed at their lower end with openings 58, 58. The projections 52, 52 extend through and are engaged with the respective openings 58, 58. The upper end of each of the levers 56, 56 is seated on the annular flange 30 of the cylindrical frame 28. A saddle 60 is carried by the levers 56, 56 and adapted to hold the valve element 22 in position when the thermally responsive assembly is in its inoperative position. The thermally responsive assembly 32 is covered by a cup-shaped heat collector 62.

When the ambient temperature exceeds a predetermined value, the fusible alloy 44 melts and escapes from the holder 42. This causes the thermally responsive assembly 32 to be blown away due to disintegration. The liquid pressure in the internal passage 20 causes the valve element 22 to be unseated from the discharge end 16 of the tubular body 12 and urged out of the frame 28 while the deflector 27 is being axially guided by the guide struts 36. At this time, the ring 34 is urged toward the open end of the frame 28 under the action of the compression spring 38. Axial movement of the ring 34 within the frame 28 is stopped when the ring 34 abuts the inner flange 30. The liquid under pressure is directed against the deflector 27 for distribution over an area to be protected.

As a feature of the present invention, the fusible alloy 44 includes at least two materials selected from the group consisting of tin, bismuth, indium, zinc, gallium and silver. In the illustrated embodiment, the fusible alloy 44 consists of 66 percent by weight of indium and 34 percent by weight of bismuth and has a melting point of 72° C. The composition and content of the fusible alloy can be chosen to give the desired melting point, as shown in TABLE 1.

TABLE 1

| MELTING | CONTENT (PERCENT BY WEIGHT) | | | | | | |
|---|---|---|---|---|---|---|---|
| POINT(° C.) | Sn | Bi | In | Zn | Ga | Ag | |
| 60 | 16.5 | 32.5 | 51.0 | | | | |
| 72 | | 34.0 | 66.0 | | | | EUTECTIC |

TABLE 1-continued

| MELTING | CONTENT (PERCENT BY WEIGHT) | | | | | | |
|---|---|---|---|---|---|---|---|
| POINT(° C.) | Sn | Bi | In | Zn | Ga | Ag | |
| 79 | 17.0 | 57.0 | 26.0 | | | | EUTECTIC |
| 89 | | 47.5 | 52.5 | | | | |
| 110 | | 67.0 | 33.0 | | | | |
| 118 | 48.0 | | 52.0 | | | | EUTECTIC |
| 130 | 56.0 | 25.5 | | 18.5 | | | EUTECTIC |
| 139 | 42.0 | 58.0 | | | | | EUTECTIC |
| 141 | | | 97.0 | | | 3.0 | EUTECTIC |
| 150 | | | 99.3 | | 0.7 | | |
| 156 | | | 100 | | | | |
| 199 | 91.0 | | | 9.0 | | | EUTECTIC |

Tin, bismuth and indium have an eutectic temperature of 59° C. The melting point of this alloy is in the range from 59° C. to 120° C. Bismuth and indium have an eutectic temperature of 72° C. The melting point of this alloy is in the range of 70° C. to 100° C. Also, tin, zinc and bismuth have an eutectic temperature of 130° C. The melting point of this alloy is in the range from 130° C. to 200° C. Gallium and silver may be added to these composite alloys to increase the operating temperature range of the thermally responsive assembly.

The present invention has been described with respect to its preferred embodiments. It is to be understood that various modifications and changes may be made without departing from the scope of the invention as defined by the appended claims.

What is claimed is:

1. A sprinkler head comprising:

a body having a first end adapted for connection to a supply of pressurized fluid and a second end;

a valve element associated with the second end of said body; and a thermally responsive assembly for normally holding said valve element in a closed position and opening said valve element at a preset temperature to permit the pressurized fluid to flow out of the second end of said body, said thermally responsive assembly including a holder, a plunger, and a fusible alloy contained within said holder and held in place by said plunger, said fusible alloy containing from 34 and 67 weight percent bismuth and from 33 to 66 weight percent indium.

2. A sprinkler head according to claim 1, wherein said fusible alloy contains 34 weight percent bismuth and 66 weight percent indium and has a melting point of about 72° C.

3. A sprinkler head according to claim 1, wherein said fusible alloy contains 47.5 weight percent bismuth and 52.5 weight percent indium and has a melting point of about 89° C.

4. A sprinkler head according to claim 1, wherein said fusible alloy contains 67 weight percent bismuth and 33 weight percent indium and has a melting point of about 110° C.

5. A sprinkler head comprising:

a body having a first end adapted for connection to a supply of pressurized fluid and a second end;

a valve element associated with the second end of said body; and a thermally responsive assembly for normally holding said valve element in a closed position and opening said valve element at a preset temperature to permit the pressurized fluid to flow out of the second end of said body, said thermally responsive assembly including a holder, a plunger, and a fusible alloy contained within said holder and held in place by said plunger, said fusible alloy containing from 16.5 to 17 weight percent tin, 32.5 to 57 weight percent bismuth, and 26 to 51 weight percent indium.

6. A sprinkler head according to claim 5, wherein said fusible alloy contains 16.5 weight percent tin, 32.5 weight percent bismuth and 51 weight percent indium and has a melting point of about 60° C.

7. A sprinkler head according to claim 5, wherein said fusible alloy contains 17 weight percent tin, 57 weight percent bismuth and 26 weight percent indium and has a melting point of about 79° C.

* * * * *